US009657445B2

(12) United States Patent
Awi Abalo et al.

(10) Patent No.: US 9,657,445 B2
(45) Date of Patent: May 23, 2017

(54) ADJUSTABLE RAIL FASTENING ASSEMBLY

(71) Applicant: HF HOLDING SA, Nivelles (BE)

(72) Inventors: Bolom Awi Abalo, Vilvoorde (BE); Michel Lens, Beersel (BE)

(73) Assignee: HF Holding SA, Nivelles (BE)

( * ) Notice: Subject to any disclaimer, the term of this patent is extended or adjusted under 35 U.S.C. 154(b) by 0 days.

(21) Appl. No.: 14/760,424

(22) PCT Filed: Feb. 11, 2014

(86) PCT No.: PCT/EP2014/052643

§ 371 (c)(1),
(2) Date: Jul. 10, 2015

(87) PCT Pub. No.: WO2014/124935

PCT Pub. Date: Aug. 21, 2014

(65) Prior Publication Data

US 2016/0002864 A1 Jan. 7, 2016

(30) Foreign Application Priority Data

Feb. 12, 2013 (EP) ..... 13154986

(51) Int. Cl.
*E01B 9/02* (2006.01)
*E01B 9/46* (2006.01)
(Continued)

(52) U.S. Cl.
CPC ..... *E01B 9/02* (2013.01); *B66C 7/08* (2013.01); *E01B 9/28* (2013.01); *E01B 9/42* (2013.01); *E01B 9/46* (2013.01); *E01B 9/60* (2013.01)

(58) Field of Classification Search
CPC ..... E01B 9/00; E01B 9/02; E01B 9/04; E01B 9/10; E01B 9/12; E01B 9/22; E01B 9/28;
(Continued)

(56) References Cited

U.S. PATENT DOCUMENTS 3,858,804 A 1/1975 Hixson
4,061,269 A 12/1977 Hixson
2011/0068182 A1* 3/2011 Bosterling ..... E01B 9/42 238/264

FOREIGN PATENT DOCUMENTS

ES 2 373 740 A1 2/2012
GB 1 544 633 A 4/1979
(Continued)

*Primary Examiner* — R. J. McCarry, Jr.
(74) *Attorney, Agent, or Firm* — Reinhart Boerner Van Deuren P.C.

(57) ABSTRACT

Assembly (10) for fastening a railway rail (1), comprising a lower platen (11) provided with through holes (111) for anchoring the lower platen to ground (40) by means of anchoring means (15), an upper platen (12) superposable on the lower platen for supporting the rail (1), and a pair of rail fastening clips (142) for fastening the rail to the upper platen (12). The lower and upper platens comprise a pair of corresponding first holes (112, 121) distinct from the through holes (111), for removably securing the upper platen (12) to the lower platen (11) by first fastening means (16) independent of the ground anchoring means (15). The upper platen (12) and the rail fastening clips (142) comprise a pair of corresponding second holes (122, 144) distinct from the first holes and from the through holes, for securing the rail fastening clips (142) to the upper platen (12) by means of second independent fastening means (17). The first holes (121) of the upper platen (12) have oblong shape with a longer axis oriented transverse to the rail (1) so as to allow for lateral adjustment of the upper platen (12) relative to the lower platen (11).

15 Claims, 8 Drawing Sheets

(51) Int. Cl.

| | |
|---|---|
| ***E01B 9/42*** | (2006.01) |
| ***E01B 9/28*** | (2006.01) |
| ***E01B 9/60*** | (2006.01) |
| ***B66C 7/08*** | (2006.01) |

(58) Field of Classification Search
CPC ..... E01B 9/30; E01B 9/38; E01B 9/40; E01B 9/42; E01B 9/44; E01B 9/48
See application file for complete search history.

(56) References Cited

FOREIGN PATENT DOCUMENTS

| | | |
|---|---|---|
| WO | WO 2009/013239 A1 | 1/2009 |
| WO | WO 2011/032969 A1 | 3/2011 |
| WO | WO 2011/110456 A1 | 9/2011 |

* cited by examiner

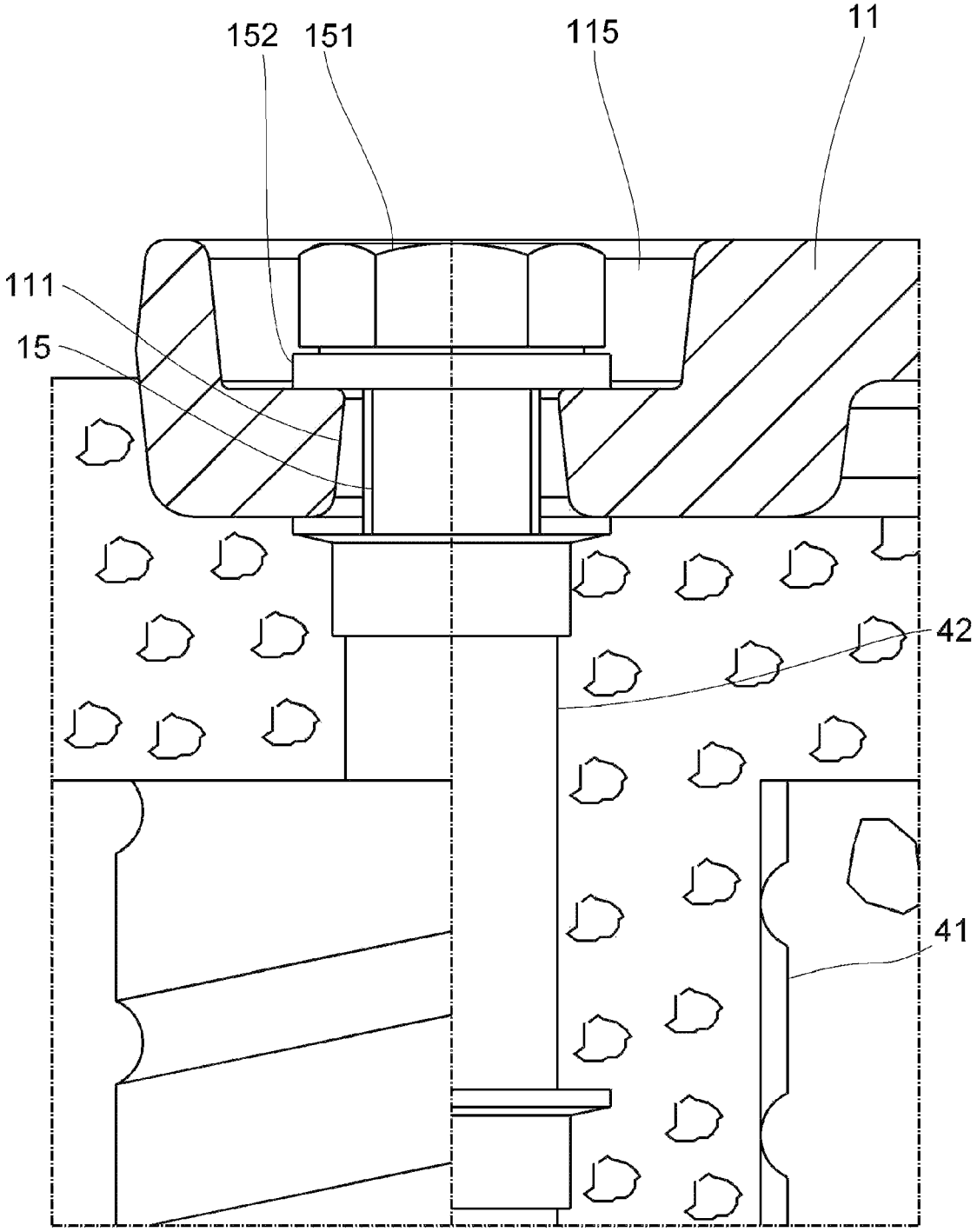
FIG 6 (C-C)

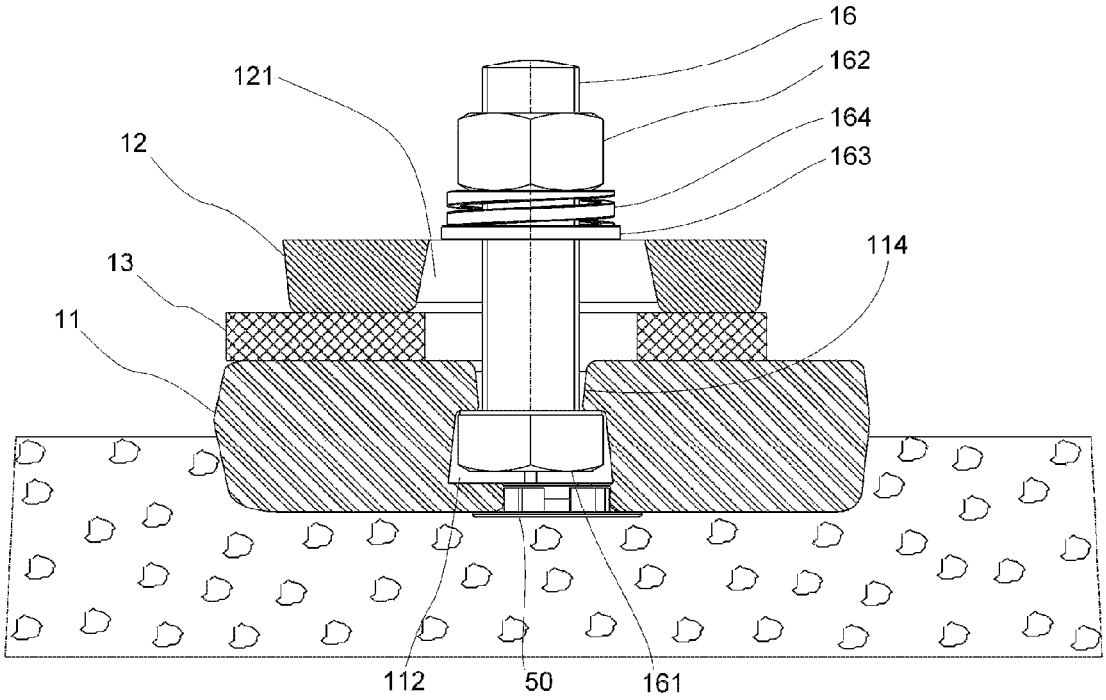
FIG 7 (B-B)
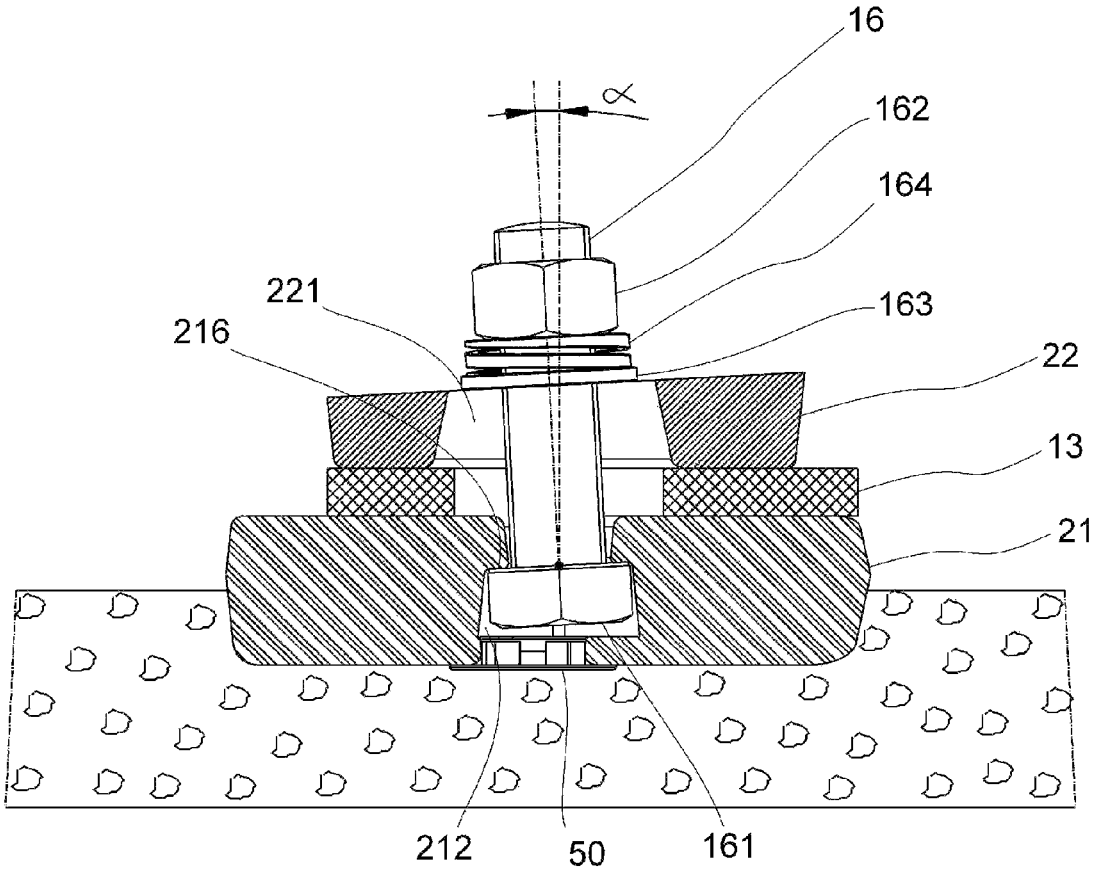
FIG 8

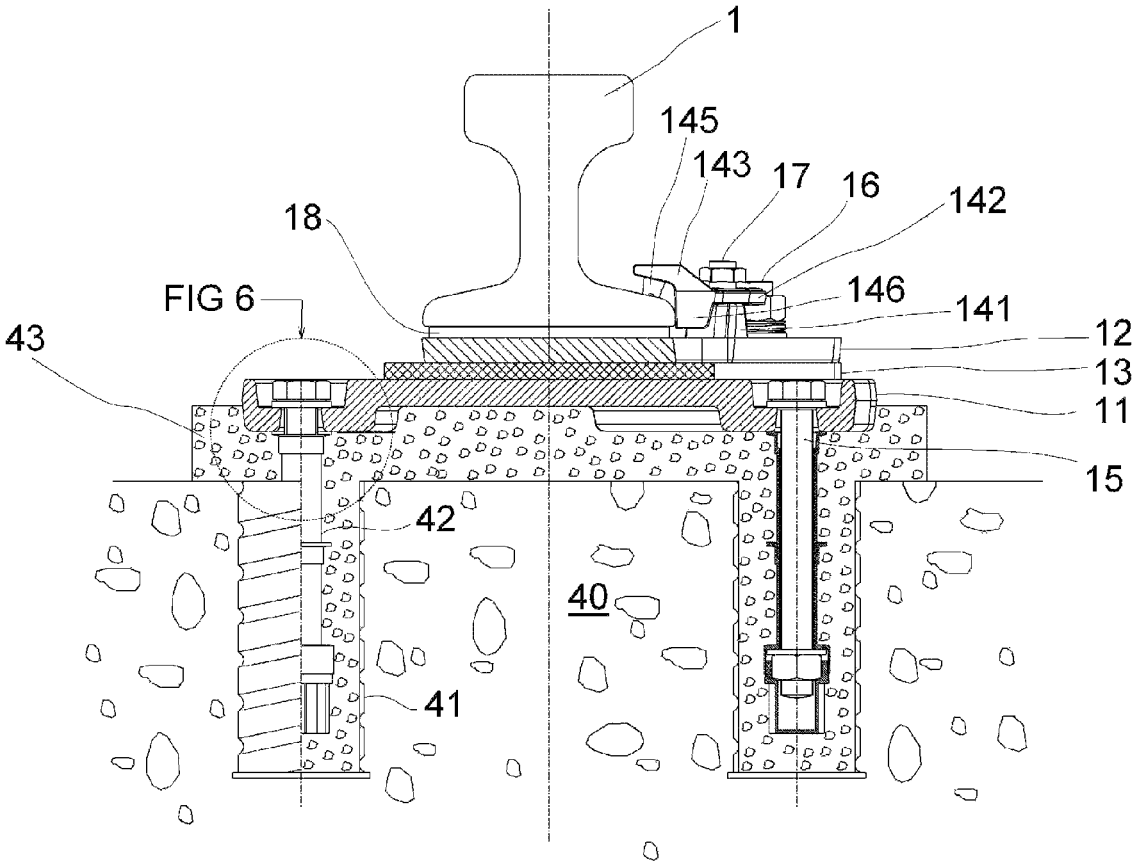
FIG 10 (D-D)

ADJUSTABLE RAIL FASTENING ASSEMBLY

The present invention is related to assemblies for fastening and securing a railway rail to ground. In particular, the invention is related to fastening assemblies providing discontinuous support for the rail, in which the rail is supported at regular intervals and freely suspended in between two supports. Fastening assemblies of the present invention are particularly suitable for supporting rails on which cranes, or other large machines circulate, such as in stacking yards for containers, or stockpile sites for ores and other bulk materials.

Worldwide container goods transport is continuously increasing. The loading capacity of current container ships exceeds 10000 container units. Once the ship docks in the port, all these containers are unloaded by large gantry cranes and moved to temporary stacking yards. In order to increase productivity, efforts are being made for reducing the loading and unloading times of these large ships. One such effort is the substitution of operator-driven cranes by so-called automated stacking cranes (ASC), which are rail mounted cranes able to perform the stacking and reclaiming tasks automatically. The absence of an operator has enabled to double the speed of the cranes moving along the rails.

However, ASCs require a higher precision in the alignment of the rail tracks. In addition, the speed increase has increased the load exerted by the crane wheels on the rails unproportionally. In view of the large number of containers, the size of the stacking yards has been increasing, and the length of the railway tracks has followed. It is not uncommon to have crane railway tracks developing for over more than 40 km length. Moreover, ports are often located in geologically unstable areas, such as estuaries, or areas reclaimed from sea. It is costly to provide for stable foundations in these zones, and consequently sagging of the railway track is commonly experienced. It will be clear that it is imperative to reduce as much as possible maintenance times of the track. Therefore, in order to be able to rapidly adjust the track, rail supports with two superposed platens have been developed, which can be shimmed in between the platens for re-levelling the rail in case of sagging of the ground. Re-levelling heights on the order of 100 mm are common.

Such a double-platen rail fastening support is known from ES 2373740, which describes a fastening assembly for supporting a rail comprising a lower platen which is anchored to ground. The rail is secured on a second, upper platen, which is superposed on the lower platen. Rail fastening clips are provided on the upper platen at both sides of the rail and secured by bolts which not only secure the clips, but also the upper platen to the lower platen.

The bottom face of the upper platen comprises a couple of projections, aligned with the rail and fitting in corresponding grooves in the lower platen's top face to facilitate autocentring of the platens on top of each other. For adjusting the height of the rail, shims of varying thickness can be inserted between the two platens, or underneath the lower platen. Lateral alignment of the rail is obtained by the provision of oblong holes in the lower platen, which are used for securing the lower platen by ground anchors.

The fastening assembly described in ES 2373740 suffers from a number of disadvantages. Firstly, the rail clips abut against abutting projections in the upper platen. Lateral forces exerted on the rail are transmitted via the clips to the upper platen, and further to the lower platen via the downward projections of the upper platen and corresponding grooves in the lower platen. The inclined engagement faces of the downward projections and grooves in the lower and upper platens cause force transmission to the lower platen to include a vertical component, which acts on the ground anchor bolts. The ground anchor bolts therefore are prone to experiencing a cyclic load. It has been observed that grout or concrete is not able to withstand such loads and has a tendency to flowing over time, such that the ground anchor loosens grip over time. As the lower platen furthermore accounts for lateral adjustment by means of the oblong ground anchoring holes, there is a risk of lateral nonalignment. Even though this is mitigated in ES 2373740 by providing serrated faces around the ground anchoring holes, the anchor must be re-tightened at regular intervals and lateral alignment should always be checked. Secondly, in case of re-levelling the rail, a shim having a peculiar shape must be inserted between the two platens. These shims have a peculiar shape, and cannot be manufactured on site, meaning that they need to be acquired and kept in stock, which increases cost. Furthermore, due to the projections and recesses with which the shims must be provided, the rail must be lifted more than the actual thickness of the shim. This can be avoided by introducing a flat shim underneath the lower platen; however this requires unscrewing the ground anchor bolts.

A fastening assembly for use with metro railway tracks is known from U.S. Pat. No. 3,858,804, which describes in relation to its FIGS. 3-8 an assembly comprising a lower platen supported on a grout pad and an upper platen which supports the rail. A resilient and electrically insulating sheet member is interposed between the lower and upper platens. Rail clips are secured to the upper platen by appropriate bolts. Studs extend through the upper and lower platens and the resilient sheet to hold the assembly together. The lower platen further comprises revealed diagonal edges with serrated top faces contouring through-slots through which anchor bolts extend for anchoring the lower platen to the grout pad. A disadvantage of this assembly is that lateral adjustment of the rail is provided by shifting the entire assembly transversely in order to position the rail to the desired gauge. This may require unscrewing and tightening the anchor bolts multiple times with a risk of reducing holding force.

Another prior art fastening assembly is depicted in FIGS. 1 and 2. This assembly comprises a lower platen 2 with planar top and bottom faces supported on a grout/concrete base and on which an upper platen 3 is superposed. The rail 1 is secured onto the upper platen 3 by a pair of rail fastening clips 4. The rail fastening clips are as described in WO 2009/013239 with a lower part welded to the upper platen 3 and an upper part fastened to the lower part and which partially overlies the rail foot. Height adjustment of the rail is obtained by inserting shims between the lower and upper platens. Different from ES 2373740 and FIGS. 3-8 of U.S. Pat. No. 3,858,804, the ground anchor bolts provide for securing both lower and upper platen, as well as any shim provided in between. Securing is obtained by four anchor bolts 6, which however renders the assembly bulkier and therefore expensive in material and installation cost.

It is an object of the present invention to provide a fastening assembly for a rail which overcomes the above drawbacks. It is an object of the present invention to provide an adjustable fastening assembly which is economical and which requires a reduced time span for adjusting. It is an object of the present invention to provide a fastening assembly which makes rail alignment easier and which provides better securement of the rail to ground.

According to the present invention, there is therefore provided an assembly for supporting and fastening a railway rail as set out in the appended claims. Assemblies of the invention comprise a lower platen, an upper platen and rail fastening clips. The lower platen is provided with through holes for anchoring it to ground by means of ground anchoring means. The upper platen, which can be stacked on the lower platen, has an upper face for supporting the rail. The rail fastening clips are configured for fastening the rail at opposite sides of it to the upper platen.

According to a first aspect of the invention, the lower and upper platens comprise a pair of corresponding first holes distinct from the through holes, for removably securing the upper platen to the lower platen by first fastening means independent of the ground anchoring means. Furthermore, the upper platen and the rail fastening clips comprise a pair of corresponding second holes distinct from the first holes and from the through holes, for securing the rail fastening clips to the upper platen by means of second fastening means independent of the first fastening means and of the ground anchoring means. Furthermore, the first holes (121) of the upper platen (12) have oblong shape with a longer axis oriented transverse to the rail (1) so as to allow for lateral adjustment of the upper platen (12) relative to the lower platen (11).

According to a second aspect of the invention, which can be provided independently of the first aspect, the lower platen comprises downwards projecting members arranged at opposite ends of the lower platen's bottom face. The lower platen is provided with a recessed region arranged between the projecting members on the bottom face and with lateral access openings providing access to the recessed region from lateral sides of the lower platen. The lateral access openings are arranged between side walls of the projecting members. The side walls are shaped such that, when a hardening filler material is poured through at least one lateral access opening, the side walls guide the filler material through the recessed region and towards another lateral access opening thereby evacuating air from the recessed region.

Additional advantageous aspects are set out in the dependent claims.

Aspects of the invention will now be described in more detail with reference to the appended drawings, which are non-limiting and wherein:

FIG. 6 represents a cross sectional view through the ground anchoring through-hole of the lower platen along section line C-C of FIG. 4, which forms a detail view of FIG. 10 and wherein the lower platen is partially embedded in grout;

FIG. 7 represents a cross sectional view through the platen assembling bolt along section line B-B of FIG. 4 and wherein the lower platen is partially embedded in grout;

FIG. 8 represents a cross sectional view as in FIG. 7, for an assembly in which the platen assembling bolt is inclined and wherein the lower platen is partially embedded in grout;

FIG. 10 represents a cross sectional view of the assembly of FIG. 3 along section line D-D of FIG. 4. The assembly is shown anchored in a concrete base with grout filling underneath the lower platen.

Figure 1:
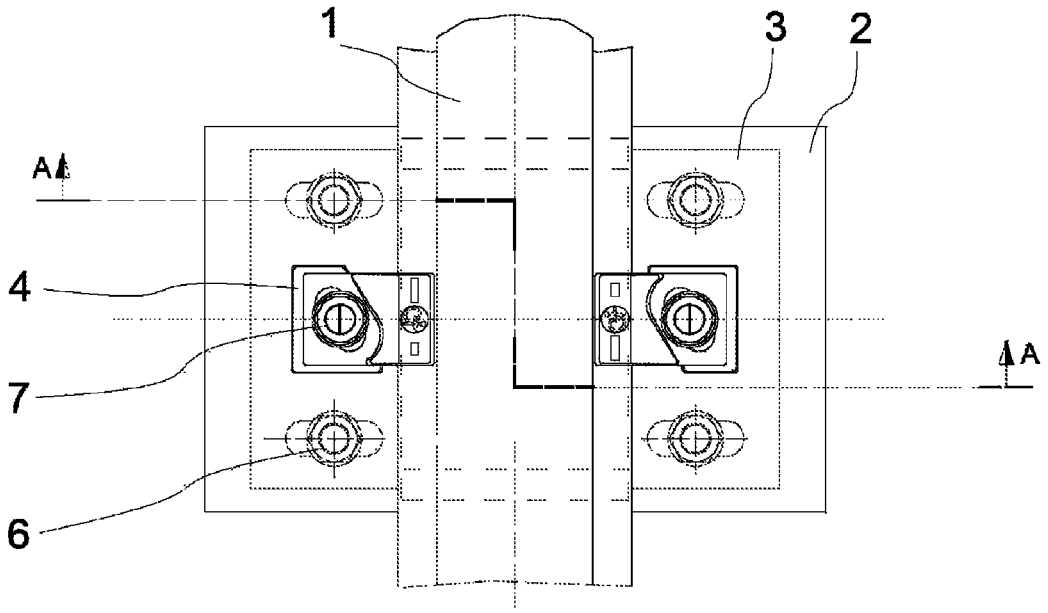
FIG 1 (PRIOR ART)
FIG. 1 represents a top view of a prior art rail fastening assembly.

Present inventors have found that improved performance of rail fastening assemblies can be obtained by separating the different fastening/securement functions of the assembly. Taking the prior art assembly of FIGS. 1 and 2 as a comparative example, it is noted that two types of fastening means are provided: the ground anchor bolts 6 and the rail fastening bolts 7. The ground anchor bolts 6 additionally ensure securement of the upper platen to the lower platen and therefore have a double function. Whereas it can be argued that the combined function makes the assembly compact and hence more economical, it has presently been found that this is nevertheless a disadvantage, since when the rail must be shimmed, the ground anchor bolts must be unscrewed. Repeated screwing and unscrewing of such bolts substantially weaken the ground anchorage and on the long term may lead to early release of the ground anchor.

Additionally, any transverse force on the rail is directly transmitted to the ground anchor bolts 6. It has presently been found that also such excessive excitation of the ground anchors leads to early loosening of the bolts.

The present inventors resolved that separating the different fastening/securing functions such that a different fastening means is used for each function, allows for overcoming the above stability problems. Unexpectedly, this separation did not lead to an increase of the bulkiness of the assembly, but instead even allowed for making the assembly more compact and hence economical from a viewpoint of material and manufacturing cost.

Surprisingly, it has been found that separating the different fastening/securing functions furthermore allowed for reliably incorporating a lateral adjustment ability of the assembly between different parts of the assembly without the need of using the ground anchor bolts.

The separation of the fastening functions will be described referring to FIGS. 3-5, which depict a fastening assembly 10 according to the present invention. Assembly 10 is used as a discontinuous support of a rail. By way of example, assemblies 10 can be provided at 0.5 m to 0.75 m intervals for supporting a rail 1.

The fastening assembly 10 comprises a lower platen 11 and an upper platen 12. Lower platen 11 is configured to form a ground support. The upper platen 12 is superposable on the lower platen 11 and is configured to support the rail 1 on top. One or more shims 13 can be provided between the lower and upper platens for height adjustment of the rail. The upper platen 12 is provided with a pair of rail fastening clips 14—one at each side of rail 1—for securing the rail to the upper platen 12. The rail fastening clips 14 are disposed at opposite sides of a flat supporting plane 125 formed on the upper platen's top face.

According to an aspect of the invention, three separate and independent fastening means are provided for securing the different components. Each fastening means cares for one single fastening or securing function. Firstly, the lower platen 11 is provided with a pair of through-holes 111 adapted to receive ground anchor bolts 15 for securing the lower platen 11 to ground. Referring to FIG. 6, through-holes 111 can be provided with a counterbore 115 on the top face of lower platen 11 to arrange that the head 151 of ground anchor bolt 15 sits below or flush with the top face of the lower platen 11. In FIGS. 3-5, the lower platen 11 is configured to be secured by two ground anchor bolts 15, but more anchor bolts can be provided if deemed required. The through-holes 111 are advantageously arranged at diagonally opposite ends of the lower platen 11. As will be discussed below, the through-holes 111 need not take care of lateral adjustment of the assembly 10, and therefore they are advantageously of circular shape.

Secondly, the upper platen 12, and any shim 13, is secured to the lower platen 11 through platen assembling bolts 16. To that end, the lower platen 11 and the upper platen 12 comprise corresponding holes 112, 121 through which the platen assembling bolts 16 can be inserted. A detailed cross sectional view of the slots is shown in FIG. 7. Hole 121 in upper platen 12 is an advantageously slot-shaped through-hole, so as to have an oblong shape, the longer axis of which is advantageously oriented in a direction transverse to the length of the rail 1. Hole 112 in lower platen 11 advantageously comprises two interconnected areas, for on the one hand accepting and on the other hand locking the head of bolt 16. Hence, a first area 113 of hole 112 is possibly formed as a recess with a shape and size adapted to accept the head of bolt 16. Hole 112 is provided at an end opposite the first area with a slotted aperture 114 partially covering the hole 112. Slotted aperture 114 is open to the first area 113. The area of hole 112 with slotted aperture 114 is configured for locking engagement with the head 161 of bolt 16 as shown in FIG. 7. At the slotted aperture, hole 112 has an inverse T-shape cross section for engagement with bolt head 161. In use, bolt head 161 is retained in the recess of hole 112 below the slotted aperture 114, while the shank projects through the slotted aperture. Rotation locking of bolt 16 is obtained by shaping the walls of hole 112 to make them correspond to the shape of the head 161 of bolt 16, such as hexagonal, to accept e.g. a hex bolt 16. To rotation-lock head 161, after bolt 16 is inserted with head 161 in hole 112 at the first area 113, the bolt 16 is translated such that it moves from the first area 113 to engage the slotted aperture 114. The possibly polygonal shape of the recess below slotted aperture 114 retains bolt head 161 to prevent rotation.

Shims 13 can be provided with slots 131, 132 for through-passage of the platen assembling bolts 16, and which are advantageously open to the circumference of shim 13 for easy insertion without having to remove the upper platen 12. A first slotted hole 131 may have an oblong shape, whereas a second slotted hole 132 may be L or V shaped with one edge open to the circumference of shim 13. The holes are advantageously open to different and preferably transversely oriented sides of the circumference of shim 13. This furthermore can provide improved resistance to creep of the shim 13 relative to the upper and lower platens due to e.g. vibration.

Figure 3:
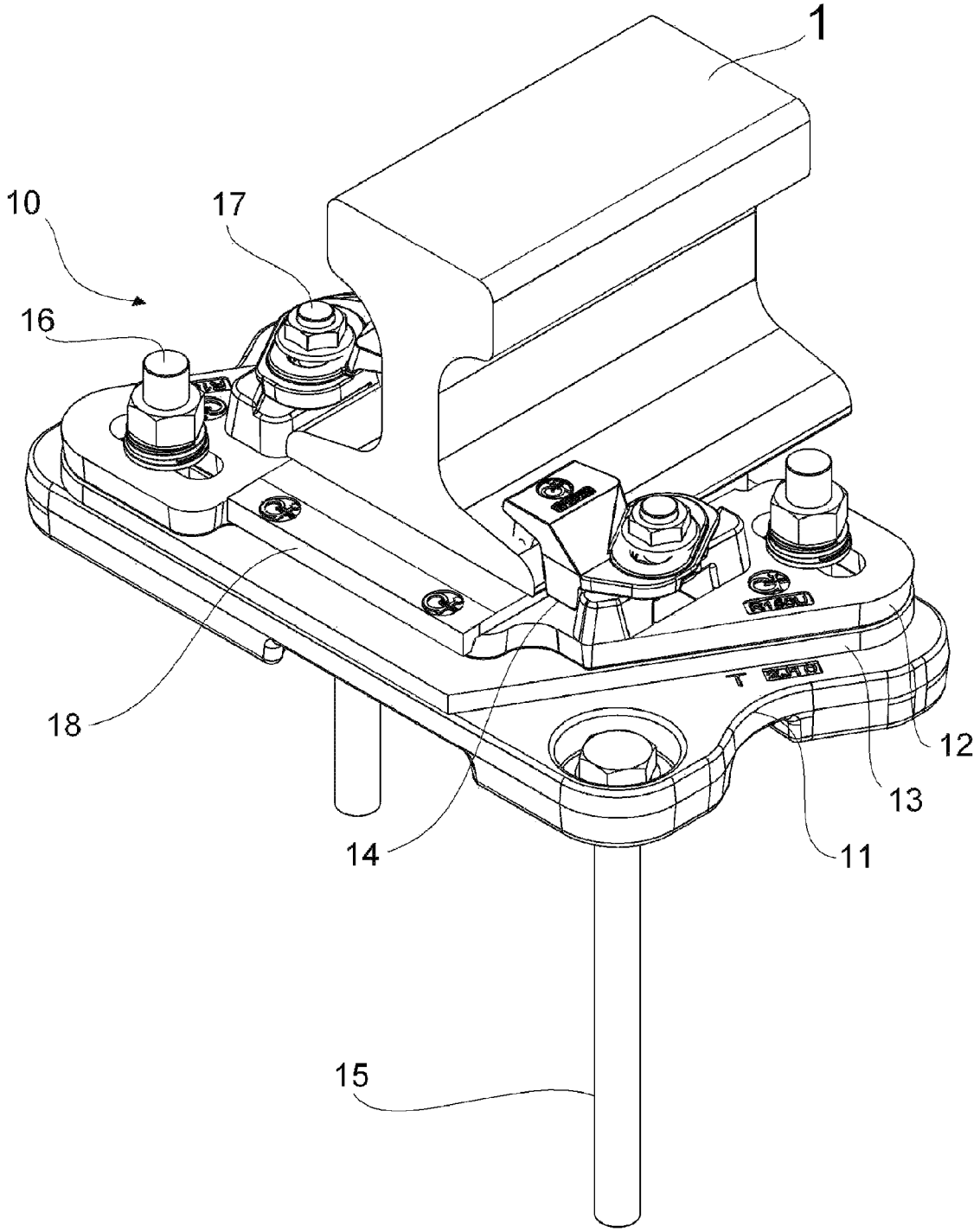
FIG. 3 represents a perspective view of a rail fastening assembly according to the invention.
Figure 4:
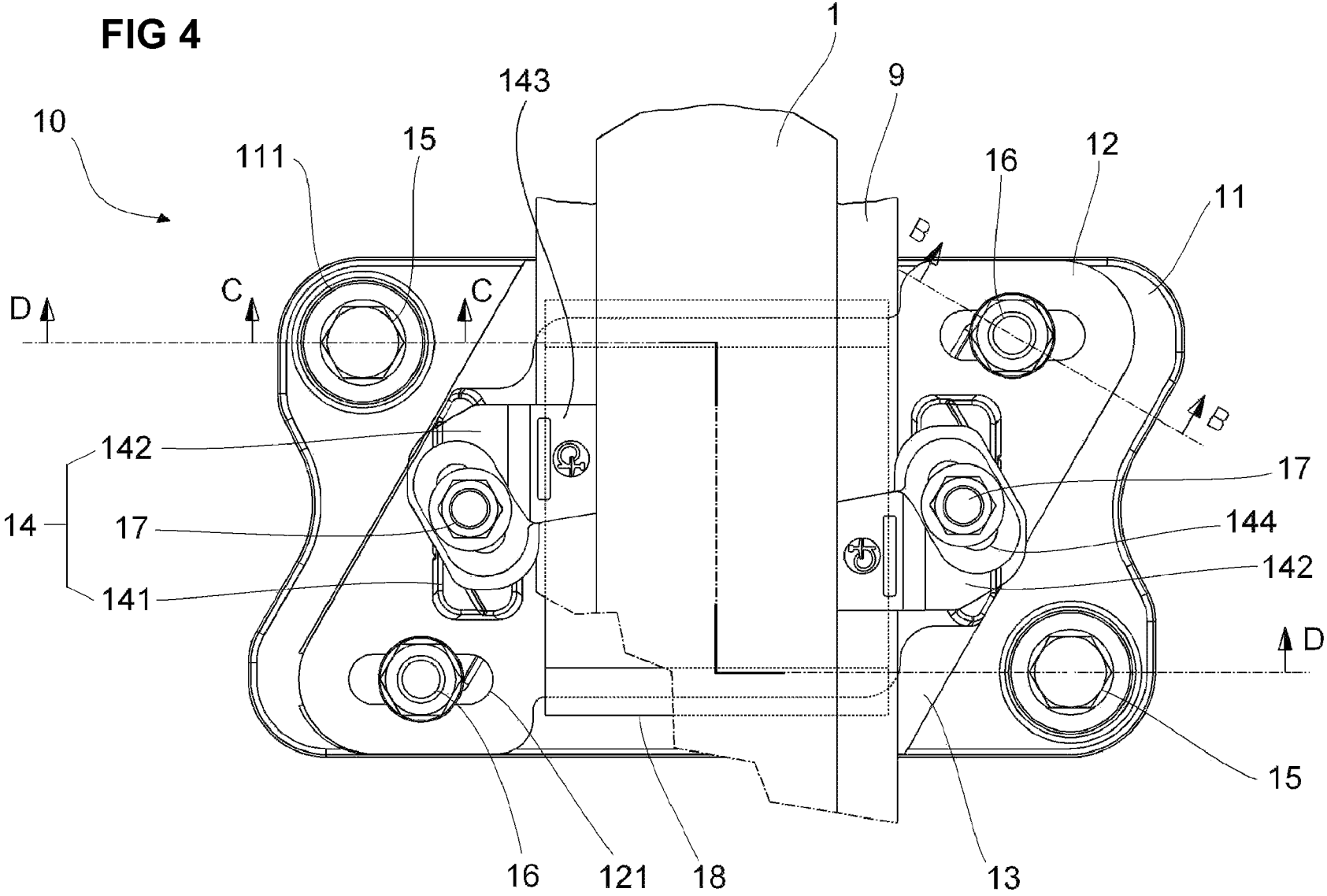
FIG. 4 represents a top view of the rail fastening assembly of FIG. 3.
Figure 5:
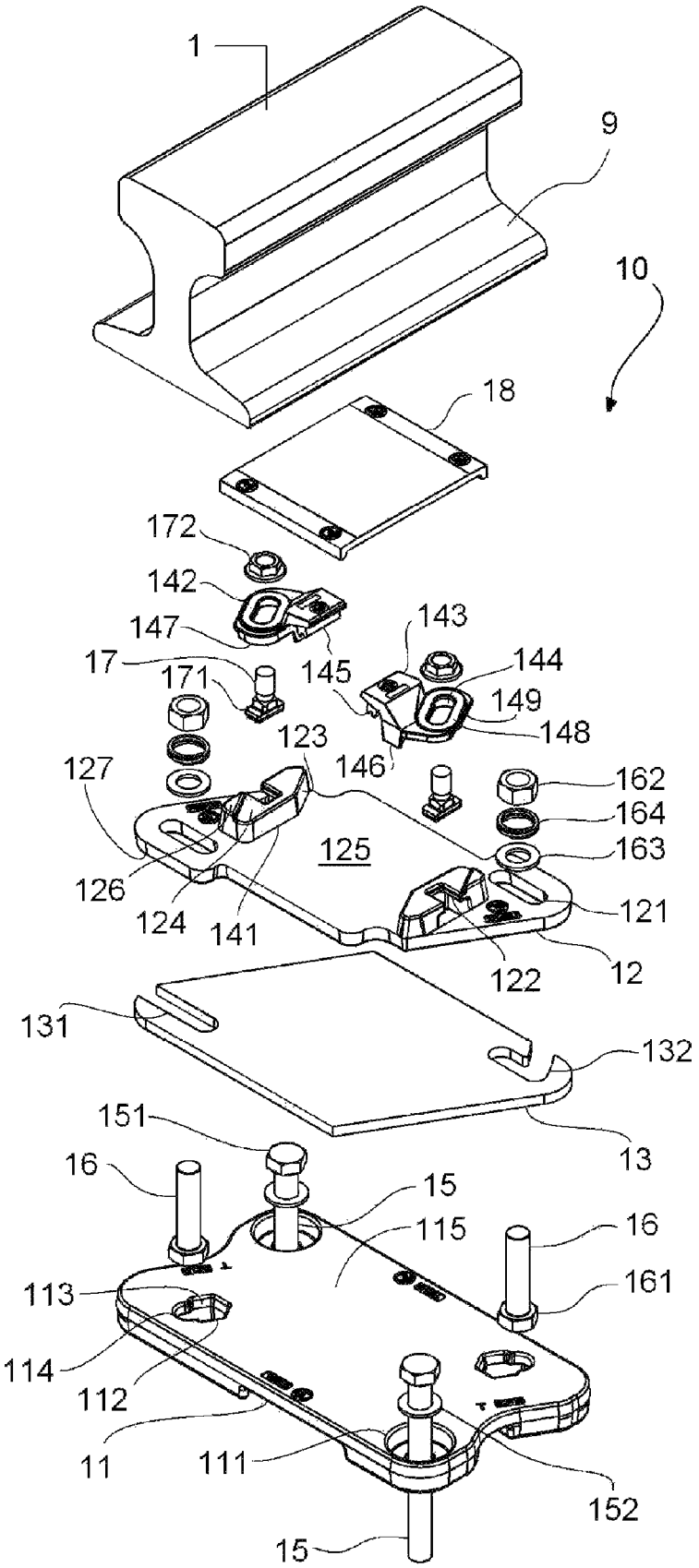
FIG. 5 represents the rail fastening assembly of FIG. 3 in exploded view.

Thirdly, the rail 1 is fastened to the upper platen 12 by means of rail fastening clips 14 as shown in FIGS. 3-5. These clips are advantageously formed as described in WO 2009/013239 and comprise a lower part or seat 141 advantageously formed integrally with the upper platen 12, and an upper part 142 integral with arm 143 adapted to overlie and secure the foot 9 of rail 1. Upper and lower parts of clip 14 are fastened by clip fastening bolt 17. To that end, the lower part 141, which is advantageously formed as a platform projecting from the supporting plane 125, comprises a recess 122 advantageously adapted for accepting the head of clip fastening bolt 17 in rotation locking engagement. Recess 122 advantageously has an inverse T-shape cross section to retain and lock the head 171 of bolt 17. A corresponding slotted hole 144 is provided in the upper part 142 of the clip 14 for passing the shank of clip fastening bolt 17 through.

The above separation of the three fastening functions allows for optimizing the fastening for each function separately, hence obtaining an easy to use yet robust assembly system. The ground anchor bolts 15 only secure the lower platen, not the upper platen. Moreover, since the upper platen 12 can be laterally adjusted relative to the lower platen 11 due to the slotted shape of the holes 121 in the upper platen, the ground anchor bolts need not be used for lateral adjustment of the rail. Therefore, once the assembly is mounted, there is no need for unscrewing the ground anchor bolts for whatever reason. The platen assembling bolts 16 only secure between the lower and upper platens. They do neither provide ground anchoring, nor rail fastening. Advantageously, platen assembling bolts 16 can be unscrewed for performing height adjustment (re-levelling), while the clip fastening bolts 17 remain tightened. Consequently, when the upper platen 12 is lifted for shimming, the rail remains secured to the upper platen 12. In addition, the lower platen 11 remains secured to ground. This allows for faster and easier adjustment and therefore saves time and cost.

Surprisingly, it has been found that in rail assemblies of the above kind, force transmission between the different parts of the assembly occurs to a much higher extent through friction between the contacting surfaces of the lower and upper platens and possible shims. Same was found to be true for force transmission between the lower platen and ground support. Without wishing to be bound by theory, it is believed that this is due to the fact that the different fastening functions have been separated, such that each kind of fastening can be appropriately designed. When force transmission is almost purely due to friction between surfaces, the fasteners only need to provide a required compressive stress between surfaces in order to obtain a desired level of friction. As the fasteners will not experience any cyclic loads, they can have a longer service life.

Moreover, separating the fastening functions and optimizing for each function separately has resulted in reduction of the bulkiness of the assembly without any loss of performance. Related aspects are described in the following.

Even though rails used for train railway tracks are subjected to wheels travelling at high speeds, the load per wheel remains considerably lower than is the case with rails for crane railways. Crane wheels exert not only a considerable vertical load on the rails, which may exceed 60 tonnes, but also a significant horizontal load. In crane railway applications, it is therefore known that it is beneficial to tightly clamp the rail with regard to lateral (transverse) movement, but not with regard to rotation movement about the longitudinal axis of the rail (torsion or rolling). A certain degree of vertical resilience in order to allow rolling motion of the rail was found beneficial for reducing the load charge on the support.

To that end, arm 143 of rail fastening clip 14 is provided at its under face with a member 145 made of a resilient material, such as an elastomeric material. Member 145 is provided such that arm 143 bears on the rail foot 9 through the resilient member 145. Additionally, a resilient pad 18 is provided on the supporting plane 125 to be interposed between the rail 1 and the upper platen 12. The member 145 and the pad 18 therefore allow a certain rolling motion of the rail 1, which reduces transfer of such loads further to the platens, and importantly, to the ground anchors. An improved stability of the ground anchors and a reduced excitation of the support platens are hence obtained.

Notwithstanding the resiliency in rotational (and thus vertical) movement, the rail foot 9 is nevertheless laterally tightly secured between the upper parts 142 of opposing rail clips 14. To that end, the upper parts 142 are advantageously provided with a downwards projecting member 146 which snugly fits between the lower part 141 of clip 14 and the rail foot 9. Member 146 is advantageously wedge-shaped to abut against abutting wall 123 of the lower part 141, which is arranged obliquely to the rail 1 in a manner to correspond to the wedge shape of projecting member 146 and hence enable adjustment and provide optimal fit. In addition, or alternatively, the lower part 141 can be provided with a member 126 projecting upwards from the lower part's top face 124. Member 126 has an abutting wall extending in a same direction as, and advantageously parallel to oblique wall 123, against which a correspondingly shaped rear edge 149 of upper part 142 is arranged to abut. Since the resilient member 145 does not extend to the lower projection 146, the rail is secured in a fixed manner as regards lateral movement. The abutting wall 123 and projecting member 126 prevent that laterally directed forces applied by the rail 1 to the clip are transmitted to the bolt 17.

As a further advantage, bottom face 147 of upper part 142, or at least that part which is advantageously arranged around slot 144, is configured for sitting on the top face 124 of the lower part 141. Faces 147 and 124 have corresponding inclinations, such that the plane of top face 124 evolves from a higher level to a lower level when approaching the rail transversely. In addition, on the top face of the upper part 142, an edge 148 is provided around slot 144, on which clip fastening bolt 17 is secured, e.g. by engagement with a nut 172. Edge 148 is advantageously inversely inclined relative to the bottom face 147, which causes the clip fastening bolt 17 to become inclined in a way that the upper part of bolt 17 (the shank end with nut 172 in the case of FIGS. 1 and 2) is oriented away from the rail 1, advantageously along the direction of extent of abutting wall 123, when the bolt 17 is fastened. The locking recess 122 in the lower part 141 of clip 14 can be provided with correspondingly shaped (inclined) engagement faces for bolt head 171. With such shaping of the clip 14, if the rail 1 tends to move laterally towards the clip 14, the upper part 142 will tend to move in the direction of extent of abutting wall 123 imparting a lifting force on the upper part due to the inclination of face 124. This has the effect of increasing the tension in the bolt 17. As bolt 17 is inclined as described above, the bolt tends to react to the lifting force by exerting a force on the upper part 142 which is directed towards the rail 1 therefore resisting any lateral movement of the rail.

A further advantage of the resilient fastening of the rail with regard to rolling motion, is that the load on platen assembling bolts 16 is relaxed. Indeed, the forces accounting for rolling motion of the rail would otherwise be transmitted in full to the assembling bolts 16, which would be subjected to cyclic alternating forces tending to reduce the tension in the bolts 16 and causing early release. Since this is not the case in assemblies of the present invention, the design of the platen assembling fastening system becomes easier and more performing. The design with locking hole 112 advantageously allows for using standard hex bolts 16. The bolts can easily and cost-effectively be replaced by ones with a longer shank whenever re-levelling would require it. The bolts 16 are used upside down and secured by an easily accessible nut 162, washer 163 and spring washer 164 on top to further avoid any loosening. When there is a need of re-levelling, it suffices to unscrew the nut, lift the upper platen 12, insert a shim 13 and tighten the nut again.

Additionally, the top face 115 of the lower platen 11 and the bottom face 127 of the upper platen 12, and the opposite faces of any shim 13 are advantageously flat. The term flat refers to the fact that corresponding faces, or at least faces which are arranged to mate when the platens are superposed, are free of projections. This reduces the height over which the rail must be lifted when shimming. Moreover, there is more freedom of design as to how the shims 13 are inserted. Referring to FIG. 5, shim 13 can be provided with slots 131 and 132 for passage of the shanks of assembling bolts 16. Slots 131, 132 can be designed to e.g. allow insertion of shim 13 between the lower and upper platens by a combination of sliding and rotation of shim 13.

It will be convenient to note that it is advantageous to be able to use flat shims 13, since these can be obtained by simple machining at the operator's site. This is advantageous, since re-levelling jobs are often urgent and there is hence no need to keep a large number of shims in stock.

The material of the platens, as well as the surface condition of the interfacing top and bottom faces are advantageously selected such as to ensure a static friction coefficient of at least about 0.4, advantageously at least about 0.5 (dry friction). Materials such as cast iron enable to obtain the above effect and at least the lower and upper platens are advantageously made of that material. The cast iron is advantageously galvanised for corrosion resistance. The above friction coefficients are considerably higher than for rolled steel or plastics and allow to further relax the load on the assembling bolts 16, since the laterally directed forces applied by the rail will be countered by friction between the platens/shims.

Hence, the upper and lower platens are advantageously made by casting. This allows for easily obtaining a suitable surface condition (roughness), and also to integrate the lower part 141 of the rail fastening clip 14 in the upper platen 12.

As a result, assembling bolts 16 only serve the purpose of keeping the platens 11, 12, 13 under a normal compressive stress in order to obtain a suitable friction force. Therefore, the load in bolts 16 is almost a pure normal tension. As an advantage, this allows the lateral adjustment functionality to be easily implemented on the upper platen. The shape of hole 121 in the upper platen 142 can hence be made oblong to provide for (coarse) lateral adjustment of the upper platen, and hence the rail, relative to the lower platen and hence ground. A fine adjustment can be made through the rail fastening clips 14, in particular by displacing the wedge-shaped projecting member 146 along oblique wall 123.

Referring to FIG. 8, it will be advantageous to incline the platen assembling bolts 16 laterally (i.e. in a plane transverse to the rail 1), relative to the gravity line. The orientation of the inclination (i.e. towards or away from the rail) is not critical, since in both cases laterally directed forces applied by the rail will increase tension in the inclined bolt 16, which resists the lateral movement of the upper platen 22. Such an inclination of the bolt 16 can be obtained by inclination of the edges around slotted hole 221 in upper platen 22, which serves to secure bolt 16 by means of nut 162 and washers 163, 164. In addition, the slotted aperture 212 in the lower platen 21 can be provided with correspondingly inclined engagement faces 216 against which bolt head 161 abuts. Needless to say, assembling bolts at opposite sides of the rail advantageously feature a symmetrical inclination.

It can be advantageous to incline the bolt 16 along an orientation such that the upper part (i.e. the shank end with nut 162 in FIG. 8) is oriented towards the rail 1. In that case, the edge around slot 221 on the top face of the upper platen 22 is inclined to evolve from a higher level towards a lower level in the direction of approaching the rail. With such an inclination, not only can the bolt 16 resist lateral movement of the upper platen relative to the lower platen, but also, by application of a horizontal force component directed away from the rail, it will tend to flatten out the bottom face of upper platen 22 to remove any sagging or bulging deformation of it and provide for an optimal surface contact between the platens 21, 22 or any shim 13 in between. This optimises frictional contact such that the upper platen 22 can better resist laterally directed forces applied by the rail.

The inclination angle α advantageously falls in the range between 1° and 20°, and is advantageously larger than or equal to 2°, advantageously larger than or equal to 3°. α is advantageously smaller than or equal to 15°, advantageously smaller than or equal to 10°.

As shown in FIGS. 3-5, by suitably positioning the different fasteners, a very compact design of the assembly can be obtained. Advantageously, two ground anchor bolts 15 arranged at diagonally opposite ends of the lower platen 11 provide for sufficient anchorage to ground. This allows for arranging two platen assembling bolts 16 at the other diagonally opposite ends of the lower platen. A rail fastening clip 14 is hence provided at each side of the rail, in between a ground anchor 15 and an assembling bolt 16.

As to the ground anchor system 15, since it functions independently of the platen assembly system and the rail fastening system, the load charge on the ground anchors is relaxed as well. Advantageously, the ground anchors do not experience other loads than the torque applied when securing the anchor bolts, and particularly do not experience cyclic load fluctuations which would otherwise reduce tension in the bolts. It will be convenient to note that due to the simple load charge on the ground anchors, any known anchor system can be used as desired by the operator.

Separating the three fastening functions additionally allows for responding to problems which are peculiar to rail mounted stacker-reclaimer machines, which are commonly used at piling sites of ores or other granular materials. It is observed that the grasping or release of material, which occurs suddenly, causes large impact forces on the rails and consequently on the support, leading to early failure of the ground anchors, despite the resilient securement of the rail 1 as described above. With assemblies of the present invention, it is additionally possible to provide a shim 13 made of a resilient material between the upper and lower platens to absorb that part of the impact force which cannot be absorbed by the resilient clamping of the rail by clips 14. The load transfer to the ground anchors 15 can hence be further reduced.

Figure 9:
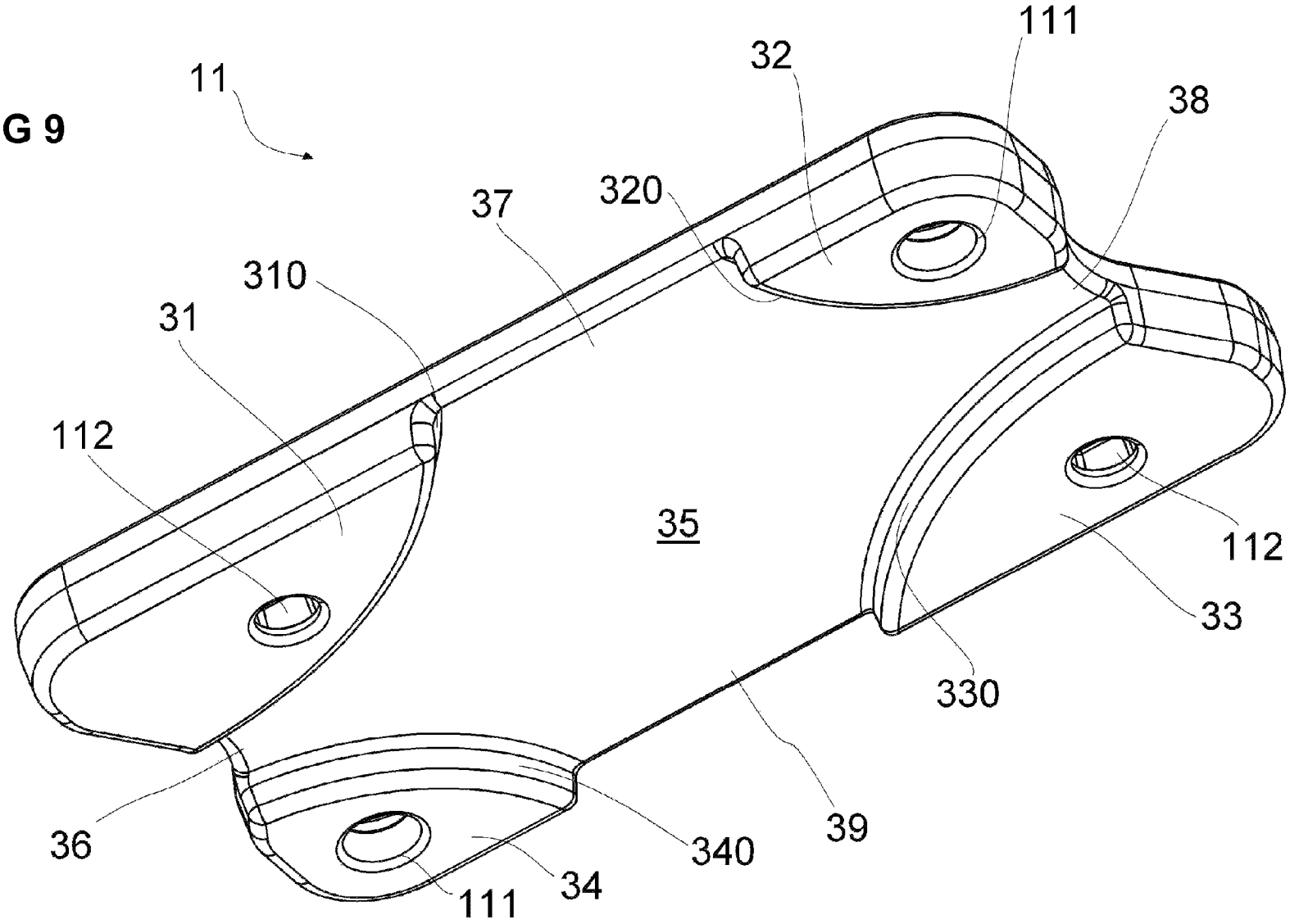
FIG. 9 represents a perspective view of the bottom face of the lower platen of FIG. 3.

According to another aspect of the invention and referring to FIG. 9, the lower platen 11 comprises at its bottom face downward projecting portions 31-34 advantageously arranged at diagonal ends of the lower platen. At the projecting portions 31-34, the lower platen has an increased thickness. The projecting portions 31-34 hence define a recessed region 35, arranged advantageously centrally between the projecting portions. The recessed region is advantageously open to the sides of the lower platen. Hence, a total of four access openings 36-39 are provided, which provide lateral access to the recessed region 35 from the outside. The openings 36-39 are advantageously arranged mutually opposite and in between the projecting portions 31-34.

Two opposite lateral access openings, namely 36 and 38 are somewhat smaller than the other two 37, 39. The smaller openings 36 and 38 can be used as feed openings for pouring grout underneath the lower platen 11. The larger openings 37, 39 are used to evacuate the air. Grout may be poured from one access opening 36, or advantageously from two opposite access openings 36 and 38 and exit from the other two access openings 37, 39 after having spread through the recessed region. When grout is poured underneath the lower platen 11 from either one, or both the (smaller) access openings 36, 38, the (larger) access openings 37, 39 allow for evacuating any air which otherwise may remain trapped underneath the lower platen and form a weak spot prone to cause rupture of the lower platen.

Projecting portions 31-34 have internal side walls 310, 320, 330, 340 respectively, which delimit the access openings 36-39 and possibly the recessed region 35. Advantageously, the internal walls 310-340 evolve so as to gradually open the smaller access openings 36, 38 towards the recessed region 35 and further towards the larger (air evacuation) openings 37, 39. When going through a (smaller) access opening, e.g. 36, from the side of the lower platen towards the recessed region 35, the side walls 310, 340 of oppositely arranged projecting members 31, 34 diverge, possibly increasingly towards the recessed region. In FIG. 9, the divergence of the side walls is such that each wall, e.g. 310, extends from one opening, e.g. 36, at one side of the platen, to the opening, e.g. 37, at the connecting side. The shape of the internal side walls 310-340 to gradually diverge between opposite side walls and hence enlarge the grout feed openings 36, 38 ensure that grout is allowed to spread through the recessed region without detaching from the internal walls, thus preventing air entrapment.

Even though four projecting members are shown in FIG. 9, it will be convenient to note that two projecting members arranged at opposite sides of the lower platen and separated by a recessed region, with two oppositely arranged lateral access openings may suffice. In such case one opening would be a feed opening, whereas the opposite one an air evacuation opening and the downward projections would extend along the side of the lower platen. However, a configuration with four lateral access openings advantageously allows for making the system symmetrical, such that the lower platen can be installed one way or the other.

It will be convenient to note that one or more additional downwards projecting members may be provided in the midst of the recessed region or of the (larger) access openings.

As a further advantage, the projecting portions 31-34 will embed in the grout and allow for better resisting horizontal forces applied on the lower platen compared to only friction, and avoid that these forces are transferred to the ground anchor bolts 15. A reliable ground anchorage is hence obtained.

Since the projecting portions 31-34 are thicker than the remainder of the lower platen, it is advantageous to provide the ground anchor through-holes 111 and the locking holes 112 for the platen assembling bolts 16 within the perimeter of the projecting portions 31-34 to save material. Referring to FIG. 7, in case lower platen 11 is made by casting, locking holes 112 may be open towards the bottom face to ease production. In order to prevent the grout entering the hole 112, a cap 50 may be provided to close the bottom opening.

It will be convenient to note that rail fastening assemblies can be provided with features of the present aspect of the invention, notably the projecting portions 31-34, irrespective of the other features of the invention, notably the separated fastening functions as described above.

Referring to FIG. 10, to mount the assembly 10 on a concrete base 40, holes 41 are drilled in the concrete base 40 at locations corresponding to the ground anchors 15. Metal studs (not shown) are fixed upright to the walls of holes 41 such that they can easily be slid. Dowels 42, which accept the ground anchor bolts 15, are attached at the underside of the lower platen by fastening the ground anchor bolts 15 through the holes 111. A washer 152 can be provided in the counterbore hole 115 to support the hex head of bolt 15. The dowels are inserted in the holes 41 and made to suspend on or from the metal studs. To obtain a correct alignment and/or height adjustment of the lower platen at a distance above the surface level of the concrete base 40, the metal studs are slid along the holes 41. When the lower platen 11 is correctly aligned, grout 43 or other hardening filler material, such as an epoxy, is poured to fill the holes 40 and the space between the concrete base 40 and the lower platen 11. Grout 43 is fed laterally from one or both (smaller) access openings 36 and 38. As described above, the downwards projecting portions 31-34 of the lower platen advantageously allow for evacuating any air through the access openings 37 and 39 and allow that the projecting portions 31-34 become embedded in the grout. Anchorage can therefore be carried out easily.

Once the lower platen 11 is fixed, platen assembling bolts 16 are inserted with their heads 161 in the first area 113 of slot 112 and displaced to the slotted aperture 114 until a locking engagement is obtained. The upper platen 12 is now mounted on top of the lower platen 11, by ensuring that the shanks of assembling bolts 16 pass through slots 121. When the upper platen 12 is at the desired (coarse) lateral position relative to the lower platen 11 (by displacement along the oblong holes 121), washer 163 and possibly spring washer 164 are moved over the bolt shank and a nut 162 is tightened on top.

A resilient pad 18 is provided on the supporting plane 125 and rail 1 is provided on top. Rail fastening bolts 17 are inserted with their heads 171 in the slots 122. The upper parts 142 of the rail fastening clip are placed on the lower parts 141 such that the bolts 17 pass through slots 144. The upper parts are moved along abutting wall 123 for a precise lateral positioning of the rail 1. The bolts 17 can now be secured by screwing nuts 172 on bolts 17.

For re-levelling the rail 1, nuts 162 on the assembling bolts 16 are unscrewed while the other bolts 15 and 17 remain tightened. The upper platen 12 can now be lifted over a distance which need not be larger than the thickness of the shim 13 to be inserted. Shim 13 is slid between the upper and lower platens, such that the shank of one assembling bolt 16 fits through slot 131. Thereafter, shim 13 is rotated about that bolt 16 until the other assembling bolt 16 fits in slot 132. Upper platen 12 is lowered and nuts 162 are tightened.

Figure 2:
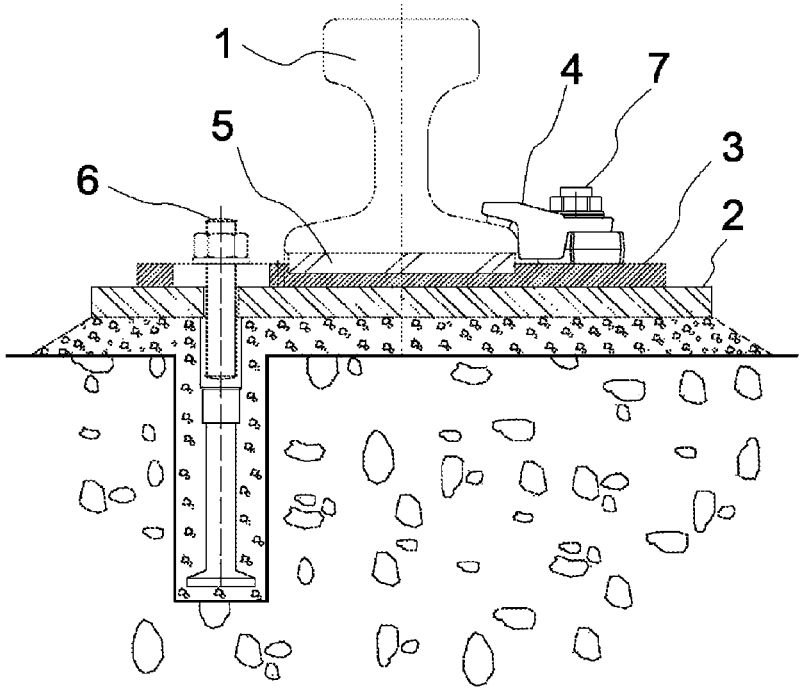
FIG 2 (PRIOR ART)
FIG. 2 represents a cross sectional view of the fastening assembly of FIG. 1 along line A-A.

Aspects of the invention allow for obtaining a 30% mass reduction compared to prior art assemblies as those depicted in FIGS. 1-2. They also allow for obtaining a 20% reduction in footprint of the lower platen. By consequence, the amount of grout is reduced as well.

The invention claimed is:

1. Assembly for fastening a railway rail, comprising:

a lower platen provided with through holes for anchoring the lower platen to ground by means of ground anchors, an upper platen having an upper face for supporting the rail, the lower platen and the upper platen being superposable, a pair of rail fastening clips configured for being arranged at opposite sides of the rail and configured for fastening the rail to the upper platen, wherein the lower and upper platens comprise a pair of corresponding first holes distinct from the through holes, for removably securing the upper platen to the lower platen by first fasteners independent of the ground anchors and wherein the upper platen and the rail fastening clips comprise a pair of corresponding second holes distinct from the first holes and from the through holes, for securing the rail fastening clips to the upper platen by means of second fasteners independent of the first fasteners and of the ground anchors, wherein the first holes of the upper platen have oblong shape with a longer axis oriented transverse to the rail so as to allow for lateral adjustment of the upper platen relative to the lower platen.

2. Assembly of claim 1, wherein the lower platen has a flat top face configured to support, and to interface with, a flat bottom face of the upper platen.

3. Assembly of claim 1, comprising a resilient pad configured to be interposed between an upper face of the upper platen and the rail and wherein each rail fastening clip is formed by a lower part and an upper part, which are superposable, the lower part being formed integrally with the upper platen, and the upper part comprising a projecting arm configured for overlying a foot of the rail and provided with a resilient member arranged such that the projecting arm bears on the foot of the rail through the resilient member.

4. Assembly of claim 1, wherein the materials of the lower platen and of the upper platen, and the surface conditions of the interfacing lower platen's top face and upper platen's bottom face are selected so as to obtain a coefficient of static dry friction of at least 0.4.

5. Assembly of claim 4, wherein the lower platen and the upper platen are made of cast iron.

6. Assembly of claim 1, wherein the lower platen comprises downwards projecting members arranged at opposite ends of the lower platen's bottom face, wherein the lower platen is provided with a recessed region arranged between the projecting members on the bottom face and with lateral access openings providing access to the recessed region from lateral sides of the lower platen, the lateral access openings being arranged between side walls of the projecting members, wherein the side walls are shaped such that, when a hardening filler material is poured through at least one lateral access opening, the side walls guide the filler material through the recessed region and towards another lateral access opening thereby evacuating air from the recessed region.

7. Assembly of claim 6, wherein the side walls of projecting members arranged at opposite sides of the at least one lateral access opening diverge towards the recessed region in a manner such that, when a hardening filler material is poured through the at least one lateral access opening, it can spread through the recessed region without detaching from the side walls, thus preventing air entrapment in the recessed region.

8. Assembly of claim 6, wherein the projecting members are provided at diagonally opposite ends of the lower platen's bottom face and the lateral access openings are provided at each side of the lower platen between the projecting members.

9. Assembly of claim 8, wherein the walls connect lateral access openings of connecting sides of the lower platen.

10. Assembly of claim 6, wherein the through holes and the first holes of the lower platen are provided within the perimeters of the projecting members.

11. Assembly of claim 1, wherein the lower platen and the upper platen comprise edges around the first holes which are configured to incline the first fasteners relative to the gravity line, so as to create a horizontal force component when the first fasteners are fastened.

12. Assembly of claim 11, wherein the edges around the first holes are configured to incline the first fasteners over an angle falling in the range between 1° and 20° relative to the gravity line.

13. Assembly of claim 1, wherein the lower platen comprises a pair of said through holes arranged at opposite ends of a first diagonal of the lower platen and a pair of said first holes arranged at opposite ends of the other diagonal and wherein each one rail fastening clip is provided between the through hole and the first hole when assembled.

14. Assembly of claim 1, comprising a shim configured for being arranged between the lower platen and the upper platen, wherein the shim is removable from the lower platen and from the upper platen and secured between them by the first fasteners, wherein top and bottom faces of the shim and corresponding faces of the lower and upper platens are substantially flat.

15. Assembly of claim 14, wherein the shim comprises slotted holes at locations corresponding to the first holes, wherein the slotted holes are open to different sides of the shim's circumference in order to allow insertion of the shim between the lower platen and the upper platen by a combination of sliding and rotation of the shim.

* * * * *